US009031437B2

(12) United States Patent
Fukami

(10) Patent No.: US 9,031,437 B2
(45) Date of Patent: May 12, 2015

(54) IMAGE FORMING APPARATUS

(71) Applicant: Tsunemitsu Fukami, Nagoya (JP)

(72) Inventor: Tsunemitsu Fukami, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 82 days.

(21) Appl. No.: 13/838,611

(22) Filed: Mar. 15, 2013

(65) Prior Publication Data

US 2013/0336669 A1 Dec. 19, 2013

(30) Foreign Application Priority Data

Jun. 19, 2012 (JP) ..... 2012-137417

(51) Int. Cl.
*G03G 15/16* (2006.01)
*G03G 15/00* (2006.01)
*G03G 15/01* (2006.01)

(52) U.S. Cl.
CPC ..... *G03G 15/5004* (2013.01); *G03G 15/0194* (2013.01); *G03G 15/1675* (2013.01)

(58) Field of Classification Search
CPC ..... G03G 15/556; G03G 15/6511; G03G 15/6588; G03G 21/0023
USPC ..... 399/100, 101, 55, 66, 297, 302, 121
See application file for complete search history.

(56) References Cited

U.S. PATENT DOCUMENTS

2006/0041765 A1* 2/2006 Taniguchi et al. ..... 713/320
2009/0080923 A1* 3/2009 Murayama ..... 399/66
2010/0303492 A1 12/2010 Furukawa et al.
2013/0230332 A1* 9/2013 Ishii ..... 399/27

FOREIGN PATENT DOCUMENTS

JP 2010-276976 A 12/2010

* cited by examiner

*Primary Examiner* — Roy Y Yi
(74) *Attorney, Agent, or Firm* — Banner & Witcoff, Ltd.

(57) ABSTRACT

An image forming apparatus includes: a first image forming unit including a first transfer unit forming a first nip with a first photosensitive drum for black; a second image forming unit including a second transfer unit forming a second nip with a second photosensitive drum for a color; and a control device which, when a first sheet and a second sheet are continuously conveyed in corresponding order by the conveyance belt at the monochrome mode, is configured to supply a first transfer current for a first time period during which the first sheet or the second sheet pass through the second nip and supply a second transfer current, which is smaller than the first transfer current, for a second time period that is a sheet interval between the first sheet and the second sheet.

20 Claims, 7 Drawing Sheets

UPPER
LOWER
FRONT
REAR
DRUM CLEANING CIRCUIT
CHARGING CIRCUIT
TRANSFER CIRCUIT
POWER SUPPLY
CPU
P1(P)
P2(P)
11K(11)
12K(12)
9K(9)
11Y(11)
12Y(12)
9Y(9)
11M(11)
12M(12)
9M(9)
11C(11)
12C(12)
9C(9)
19K(19)
19Y(19)
19M(19)
19C(19)
13
31
32
33
34
35
36
40
41
42
43
44
45
46
47
18
I

UPPER
LOWER
FRONT
REAR
DRUM CLEANING CIRCUIT
CHARGING CIRCUIT
TRANSFER CIRCUIT
POWER SUPPLY
CPU
11K(11)
12K(12)
9K(9)
11Y(11)
12Y(12)
9Y(9)
11M(11)
12M(12)
9M(9)
11C(11)
12C(12)
9C(9)
19K(19)
19Y(19)
19M(19)
19C(19)
P1(P)
P2(P)
I
13
31
32
33
34
35
36
40
41
42
43
44
45
46
47
18

UPPER
LOWER
FRONT
REAR
DRUM CLEANING CIRCUIT
CHARGING CIRCUIT
TRANSFER CIRCUIT
POWER SUPPLY
CPU
P1(P)
P2 (P)
I
11K(11)
12K(12)
9K(9)
19K(19)
11Y(11)
12Y(12)
9Y(9)
19Y(19)
11M(11)
12M(12)
9M(9)
19M(19)
11C(11)
12C(12)
9C(9)
19C(19)
13
31
32
33
34
35
36
40
41
42
43
44
45
46
47
18

IMAGE FORMING APPARATUS

CROSS-REFERENCE TO RELATED APPLICATIONS

This application claims priority from Japanese Patent Application No. 2012-137417 filed on Jun. 19, 2012, the entire subject matter of which is incorporated herein by reference.

TECHNICAL FIELD

The invention relates to an image forming apparatus of an electrophotographic type.

BACKGROUND

For an image forming apparatus of an electrophotographic type, there have been proposed a direct tandem-type color printer having a plurality of photosensitive members provided in correspondence to respective colors and configured to directly transfer developer images formed on the respective photosensitive members to a sheet.

For example, there have been proposed a color printer having four photosensitive drums provided in correspondence to respective colors of black, yellow, magenta and cyan, a conveyance belt conveying a sheet with contacting all the photosensitive drums and four transfer rollers provided in correspondence to each of the four photosensitive drums.

In the related-art color printer, a transfer current is supplied between the photosensitive drums and transfer rollers for color printing at a monochrome printing operation. Thereby, the related-art color printer suppresses a reverse transfer of a monochrome image from a sheet to which the monochrome image is transferred to the color photosensitive drums.

SUMMARY

Illustrative aspects of the invention provide an image forming apparatus capable of suppressing the power consumption.

According to one illustrative aspect of the invention, there is provided an image forming apparatus comprising: a conveyance belt configured to convey a sheet; a first image forming unit; a second image forming unit; and a control device configured to control a transfer current flowing to the second nip. The first image forming unit is configured to form a monochrome image at a monochrome mode and comprising: a first photosensitive drum for black; and a first transfer unit configured to nip the conveyance belt with the first photosensitive drum so as to form a first nip. The second image forming unit is configured to form a color image at a color mode and comprising: a second photosensitive drum for a color except for black; and a second transfer unit configured to nip the conveyance belt with the second photosensitive drum so as to form a second nip. When a first sheet and a second sheet are continuously conveyed in corresponding order by the conveyance belt at the monochrome mode, the control device is configured to: supply a first transfer current for a first time period during which the first sheet or the second sheet pass through the second nip; and supply a second transfer current, which is smaller than the first transfer current, for a second time period that is a sheet interval between the first sheet and the second sheet.

DETAILED DESCRIPTION

<General Overview>

Figure 1:
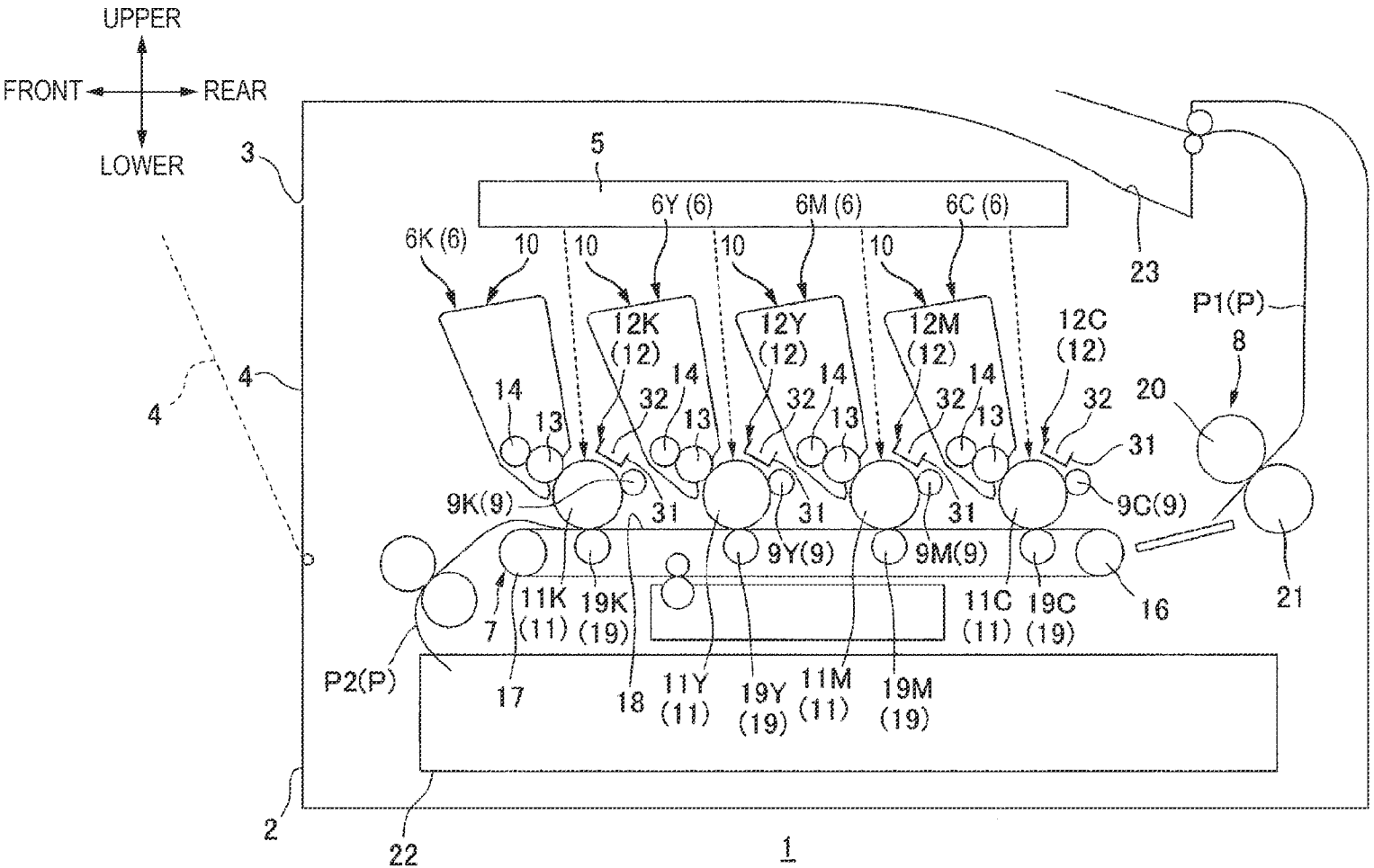
FIG. 1 is a side sectional view showing a printer that is an example of the image forming apparatus of the invention.

According to the above-described related-art color printer, when a monochrome printing operation is continuously performed for a plurality of sheets, the same transfer current as that of a case where a sheet passes is supplied between the photosensitive drums and transfer rollers for color printing even for a sheet interval (e.g., a time period after a sheet first printed passes until a sheet to be printed next time is fed). Thus, it is difficult to suppress the power consumption.

Therefore, illustrative aspects of the invention provide an image forming apparatus capable of suppressing the power consumption.

According to one illustrative aspect of the invention, there is provided an image forming apparatus comprising: a conveyance belt configured to convey a sheet; a first image forming unit; a second image forming unit; and a control device configured to control a transfer current flowing to the second nip. The first image forming unit is configured to form a monochrome image at a monochrome mode and comprising: a first photosensitive drum for black; and a first transfer unit configured to nip the conveyance belt with the first photosensitive drum so as to form a first nip. The second image forming unit is configured to form a color image at a color mode and comprising: a second photosensitive drum for a color except for black; and a second transfer unit configured to nip the conveyance belt with the second photosensitive drum so as to form a second nip. When a first sheet and a second sheet are continuously conveyed in corresponding order by the conveyance belt at the monochrome mode, the control device is configured to: supply a first transfer current for a first time period during which the first sheet or the second sheet pass through the second nip; and supply a second transfer current, which is smaller than the first transfer current, for a second time period that is a sheet interval between the first sheet and the second sheet.

According to the above configuration, the control device supplies the second transfer current, which is smaller than the first transfer current, to the second nip for the second time period that is the sheet interval between the first sheet and the second sheet.

Therefore, when printing a plurality of sheets (e.g., first and second sheets), which is continuously conveyed, at the monochrome mode, it is possible to suppress the power consumption of the second image forming unit for forming a color image.

As a result, it is possible to suppress the power consumption of the image forming apparatus.

According to another illustrative aspect of the invention, the second transfer current is zero.

According to the above configuration, it is possible to further suppress the power consumption of the second image forming unit during the continuous printing at the monochrome mode.

According to still another illustrative aspect of the invention, when the first sheet and the second sheet are continuously conveyed in corresponding order by the conveyance belt at the color mode, the control device is configured to supply a third transfer current that is larger than the first transfer current for the first time period.

According to the above configuration, it is possible to set the first transfer current, which is supplied during the continuous printing at the monochrome mode, to be smaller than the third transfer current that is supplied during the continuous printing at the color mode.

Therefore, it is possible to further suppress the power consumption of the second image forming unit during the continuous printing at the monochrome mode.

According to still another illustrative aspect of invention, the first image forming unit comprises a first charging member configured to charge a surface of the first photosensitive drum. The second image forming unit comprises a second charging member configured to charge a surface of the second photosensitive drum. When forming an image at the monochrome mode, the control device is configured to: control the first charging member to charge the first photosensitive drum to a first charging bias; and control the second charging member to charge the second photosensitive drum to a second charging bias having an absolute value that is smaller than that of the first charging bias.

According to the above configuration, when forming an image at the monochrome mode, it is possible to set an absolute value of the second charging bias of the second photosensitive drum for forming a color image to be smaller than an absolute value of the first charging bias of the first photosensitive drum for forming a monochrome image.

Therefore, it is possible to further suppress the power consumption of the second image forming unit during the continuous printing at the monochrome mode.

According to still another illustrative aspect of invention, when forming an image at the monochrome mode, the control device is configured to control the absolute value of the second charging bias to be smaller than an absolute value of a third charging bias that is a charging potential of the second photosensitive drum when forming an image at the color mode.

According to the above configuration, it is possible to further suppress the power consumption of the second image forming unit during the continuous printing at the monochrome mode.

According to still another illustrative aspect of the invention, the second image forming unit comprises a holding member configured to contact the second photosensitive drum and hold developer attached on a surface of the second photosensitive drum.

According to the above configuration, if the first transfer current is continuously supplied to the second nip for the sheet interval between the first sheet and the second sheet, the current may excessively flow between the second photosensitive drum and the second transfer unit for forming a color image. Then, due to the current, a charging potential of the second photosensitive drum may vary with respect to a charged polarity of the developer, so that the developer collected by the holding member may be again attached to the second photosensitive drum.

However, according to the image forming apparatus of the invention, the second transfer current, which is smaller than the first transfer current, is supplied to the second nip for the sheet interval between the first sheet and the second sheet.

Therefore, it is possible to suppress the current from excessively flowing between the second photosensitive drum and the second transfer unit for the sheet interval between the first sheet and the second sheet.

As a result, it is possible to suppress the charged polarity of the second photosensitive drum from being varied, so that it is possible to suppress the developer collected by the holding member from being again attached to the second photosensitive drum.

According to still another illustrative aspect of the invention, when forming an image at the monochrome mode, the control device is configured to control the second charging member to: charge the second photosensitive drum to the second charging bias for a time period corresponding to the first time period; and charge the second photosensitive drum to a fourth charging bias that is larger than an absolute value of the second charging bias for a time period corresponding to the second time period.

According to the above configuration, the second photosensitive drum is beforehand charged to the fourth charging bias having an absolute value larger than that of the second charging bias for a time period corresponding to the second time period, so that it is possible to suppress the current from excessively flowing between the second photosensitive drum and the second transfer unit for the second time period.

As a result, it is possible to securely suppress the developer collected by the holding member from being again attached to the second photosensitive drum.

According to still another illustrative aspect of the invention, the first charging member and the second charging member are scorotron-type chargers.

According to the above configuration, it is possible to reduce the ozone that is generated from the first charging member and the second charging member.

According to still another illustrative aspect of the invention, the first image forming unit is disposed at a more upstream side than the second image forming unit in a sheet conveyance direction.

According to the above configuration, a developer image that is formed on the sheet by the first image forming unit may be reversely transferred to the second photosensitive drum in the second image forming unit that is disposed at a downstream side in a sheet conveyance direction.

However, according to the image forming apparatus of the invention, as described above, the first transfer current is supplied to the second nip for the first time period during which the first sheet and the second sheet pass through the second nip.

Therefore, it is possible to suppress the developer image, which is formed on the sheet by the first image forming unit, from being reversely transferred to the second photosensitive drum.

According to still another illustrative aspect of the invention, the image forming apparatus further comprises a third image forming unit configured to form a color image together with the second image forming unit at the color mode. The third image forming unit comprises: a third photosensitive drum for a color except for black; a third transfer unit configured to nip the conveyance belt with the third photosensitive drum so as to form a third nip; and a third charging member configured to charge a surface of the third photosensitive drum. The third image forming unit is disposed at a downstream side just after the first image forming unit and at a more upstream side than the second image forming unit in a sheet conveyance direction. When forming an image at the monochrome mode, the control device is configured to control the third charging member to charge the third photosensitive drum to a fifth charging bias having an absolute value larger than that of the second charging bias.

According to the above configuration, it is possible to set an absolute value of the charging potential of the third photosensitive drum larger by the fifth charging bias.

Therefore, it is possible to suppress the developer image, which is formed on the sheet by the first image forming unit, from being reversely transferred to the third photosensitive drum.

According to still another illustrative aspect of the invention, when the first sheet and the second sheet are continuously conveyed in corresponding order by the conveyance belt at the monochrome mode, the control device is configured to control a transfer current flowing to the third nip so as to supply a fifth transfer current for a third time period during which the first sheet and the second sheet pass through the third nip and for a fourth time period that is a sheet interval between the first sheet and the second sheet.

According to the above configuration, it is possible to always supply the fifth transfer current to the third nip at the monochrome mode.

Therefore, it is possible to further suppress the developer image, which is formed on the sheet by the first image forming unit, from being reversely transferred to the third photosensitive drum.

According to still another illustrative aspect of the invention, the control device is configured to supply the second transfer current when a part between a trailing end of an image forming area defined in the first sheet and a trailing end of the first sheet passes through the second nip.

According to the above configuration, it is possible to securely supply the second transfer current to the second nip before the trailing end of the first sheet passes through the second nip.

According to still another illustrative aspect of the invention, the control device is configured to supply the first transfer current when a part between a leading end of an image forming area defined in the second sheet and a leading end of the second sheet passes through the second nip.

According to the above configuration, it is possible to securely suppress the developer image, which is formed in the image forming area on the sheet by the first image forming unit, from being reversely transferred to the second photosensitive drum.

According to the image forming apparatus of the invention, it is possible to suppress the power consumption of the image forming apparatus.

EXEMPLARY EMBODIMENTS

Exemplary embodiments of the invention will now be described with reference to the drawings.

1. Overall Configuration of Printer

As shown in FIG. 1, a printer 1, which is an example of the image forming apparatus according to a first exemplary embodiment, is a direct tandem-type color laser printer of a horizontal arrangement type.

Incidentally, in the below descriptions, the directions are described on the basis of a state where the printer 1 is horizontally put. That is, the left of FIG. 1 is referred to as the front and the right of FIG. 1 is referred to as the rear. Also, the left and the right are described on the basis of a state where the printer 1 is seen from the front. That is, the front side of FIG. 1 is the right and the inner side of FIG. 1 is the left.

The printer 1 includes a body casing 2 having a substantial box shape. A front end portion of the body casing 2 is formed with a body opening 3 that enables the inside and outside of the body casing 2 to communicate with each other. A front wall of the body casing 2 is provided with a front cover 4 that opens and closes the body opening 3.

The printer 1 includes, in the body casing 2, a scanner unit 5, a process unit 6, a conveyance unit 7 and a fixing unit 8.

The scantier unit 5 is arranged at an upper end portion of the body casing 2. The scanner unit 5 is configured to emit laser beams towards photosensitive drums 11 (which will be described later) of the process unit 6 (refer to the dotted line in FIG. 1), based on image data, thereby exposing the photosensitive drums 11 (which will be described later).

The process unit 6 is arranged below the scanner unit 5 and above the conveyance unit 7. The process unit 6 is configured to slide in the front-rear direction and to be pulled out to an outside of the body casing 2 via the body opening 3.

The process unit 6 includes: a black process unit 6K that is an example of the first image forming unit; a yellow process unit 6Y that is an example of the third image forming unit; and a magenta process unit 6M and a cyan process unit 6C that are an example of the second image forming unit.

The respective process units 6K, 6Y, 6M, 6C are arranged in parallel at an interval in the front-rear direction (parallel direction and conveyance direction) in order of black, yellow (which is an example of the color), magenta (which is an example of the color) and cyan (which is an example of the color). Each of the process units 6K, 6Y, 6M, 6C includes a photosensitive drum 11, a scorotron-type charger 12, a drum cleaning roller 9, a developing cartridge 10 and a transfer roller 19.

Each photosensitive drum 11 has a cylindrical shape that is long in the left-right direction and is rotatably supported to the corresponding process unit 6. Also, the photosensitive drum 11 is grounded.

Incidentally, the black photosensitive drum 11K that is supported to the black process unit 6K is an example of the first photosensitive drum. Further, the magenta photosensitive drum 11M that is supported to the magenta process unit 6M and the cyan photosensitive drum 11C that is supported to the cyan process unit 6C are an example of the second photosensitive drum. Still further, the yellow photosensitive drum 11Y that is supported to the yellow process unit 6Y is an example of the third photosensitive drum.

Each scorotron-type charger 12 is arranged to face the corresponding photosensitive drum 11 at an interval at the rear-upper side of the photosensitive drum.

Incidentally, the scorotron-type charger 12K facing the black photosensitive drum 11K is an example of the first charging member. Further, the scorotron-type charger 12M facing the magenta photosensitive drum 11M and the scorotron-type charger 12C facing the cyan photosensitive drum 11C are an example of the second charging member. Still further, the scorotron-type charger 12Y facing the yellow photosensitive drum 11Y is an example of the third charging member.

Each drum cleaning roller 9 is arranged at the rear-lower side of the corresponding scorotron-type charger 12 and is configured to contact the corresponding photosensitive drum 11 from the rear side of the photosensitive drum.

Incidentally, the drum cleaning roller 9M facing the magenta photosensitive drum 11M and the drum cleaning roller 9C facing the cyan photosensitive drum 11C are an example of the holding member.

Each developing cartridge 10 is detachably supported to the corresponding process unit 6 at the upper of the corresponding photosensitive drum 11. The developing cartridge 10 includes a developing roller 13.

The developing roller 13 is rotatably supported at a lower end portion of the developing cartridge 10 so that it is exposed from the rear. The developing roller 13 is configured to contact the photosensitive drum 11 from the upper of the photosensitive drum.

Incidentally, the developing cartridge 10 includes: a supply roller 14 configured to supply toner to the developing roller 13; and a layer thickness regulation blade (not shown) configured to regulate a thickness of the toner supplied to the developing roller 13. The toner (one example of developer) that corresponds to each color is accommodated in an upper space of the supply roller and the layer thickness regulation blade.

Each transfer roller 19 is arranged to face the corresponding photosensitive drum 11 with an upper part of the conveyance belt 18 (which will be described later) being interposed therebetween. The transfer roller 19 is applied with a transfer bias having a negative polarity. By the transfer bias, a transfer current is enabled to flow between the transfer roller 19 and the photosensitive drum 11.

Incidentally, the black transfer roller 19K facing the black photosensitive drum 11K is an example of the first transfer unit. Further, the magenta transfer roller 19M facing the magenta photosensitive drum 11M and the cyan transfer roller 19C facing the cyan photosensitive drum 11C are an example of the second transfer unit. Still further, the yellow transfer roller 19Y facing the yellow photosensitive drum 11Y is an example of the third transfer unit.

The conveyance unit 7 is arranged below the respective process units 6. The conveyance unit 7 includes a driving roller 16, a driven roller 17 and a conveyance belt 18.

The driving roller 16 is arranged at a rear end portion of the conveyance unit 7.

The driven roller 17 is arranged at a front end portion of the conveyance unit 7 such that it is arranged to face the driving roller 16 at an interval at the front of the driving roller.

The conveyance belt 18 is wound onto the driving roller 16 and the driven roller 17 such that an upper part of the belt contacts all the photosensitive drums 11. The conveyance belt 18 is configured to circulate such that the upper part thereof moves from the front towards the rear as the driving roller 16 drives and the driven roller 17 is thus driven.

The fixing unit 8 is arranged at the rear of the conveyance unit 7. The fixing unit 8 includes a heating roller 20 and a pressing roller 21 that faces the heating roller 20.

When an image forming operation of the printer 1 starts, the toner in the developing cartridge 10 is positively friction-charged between the supply roller 14 and the developing roller 13 and is carried on a surface of the developing roller 13 as a thin layer having a predetermined thickness by the layer thickness regulation blade (not shown).

In the meantime, a surface of the photosensitive drum 11 is uniformly charged by the scorotron-type charger 12, which is arranged to face the photosensitive drum 11 at the rear-upper side of the photosensitive drum, and is then exposed based on predetermined image data by the scanner unit 5. Thereby, an electrostatic latent image based on the image data is formed. The toner carried on the developing roller 13 is then supplied to the electrostatic latent image on the surface of the photosensitive drum 11, so that a toner image (developer image) is carried on the surface of the photosensitive drum 11.

A sheet P is accommodated in a sheet feeding tray 22 that is provided at a bottom part of the body casing 2. The sheet P is conveyed to U-turn towards the rear-upper side by a variety of rollers and is fed one at a time between the photosensitive drums 11 and the conveyance belt 18 at predetermined timing. Then, the sheet P is conveyed from the front towards the rear between the photosensitive drums 11 and the transfer rollers 19 by the conveyance belt 18. At this time, the toner image is transferred to the sheet P by the transfer bias.

Then, the sheet P having the toner image transferred thereto is heated and pressurized when passing between the heating roller 20 and the pressing roller 21. At this time, the toner image is heat-fixed on the sheet P.

After that, the sheet P is conveyed to U-turn towards the front-upper side and is then discharged onto a sheet discharge tray 23 that is provided on an upper surface of the body casing 2.

Figure 2:
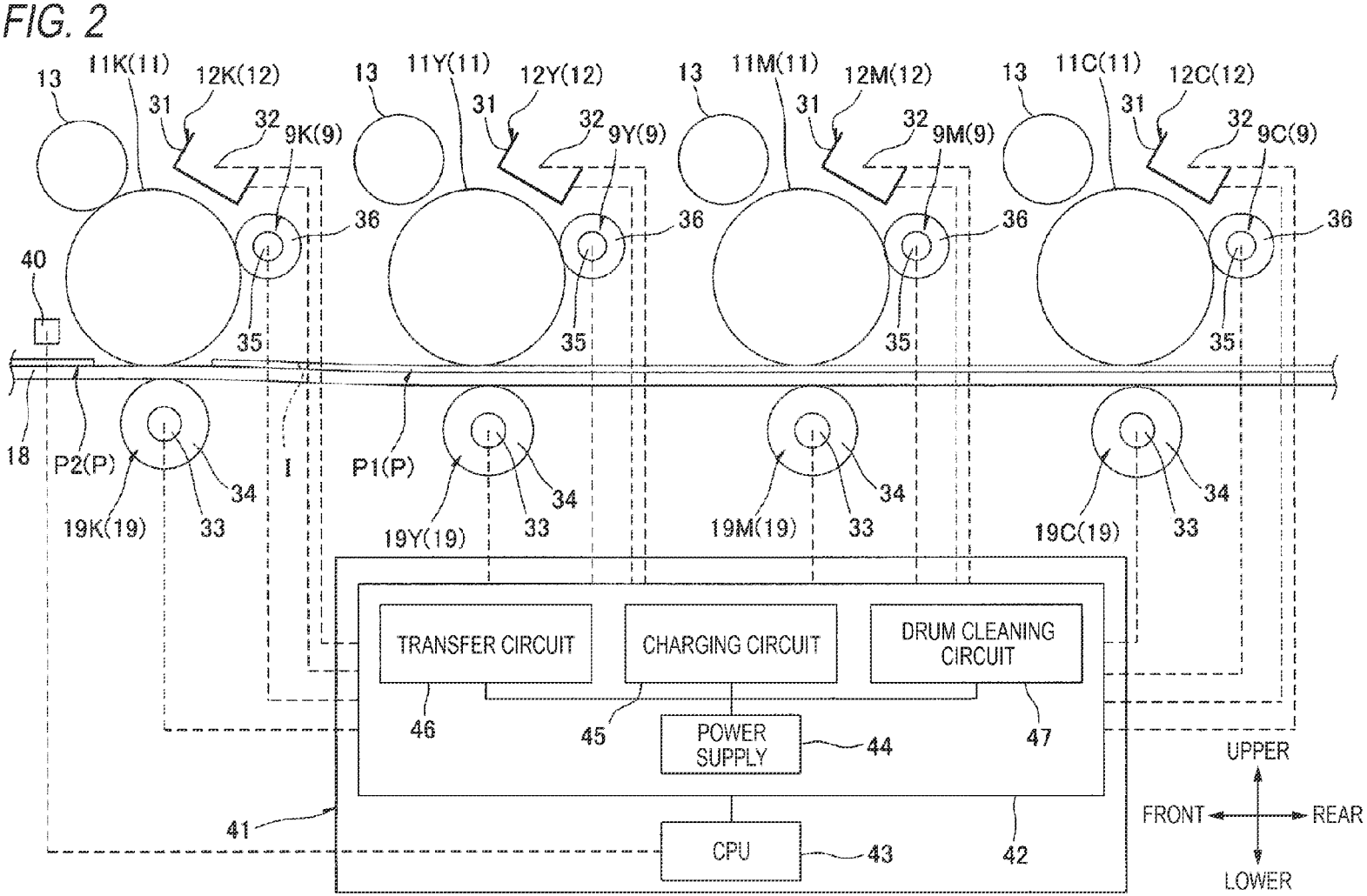
FIG. 2 shows a case where an image is formed at a monochrome mode, illustrating an aspect where a trailing end of a first sheet has passed between a black photosensitive drum and a black transfer roller and a leading end of a second sheet is fed between the black photosensitive drum and the black transfer roller.

2. Details of Scorotron-Type Charger, Transfer Roller and Drum Cleaning Roller (1) Scorotron-Type Charger As shown in FIG. 2, the scorotron-type charger 12 includes a grid 31 and a charging wire 32.

The grid 31 extends in the left-right direction and has an upper end portion that is opened towards the rear-upper side and a cylindrical shape having a substantially U-shaped section.

The charging wire 32 is arranged in the grid 31. The charging wire 32 has a substantially linear shape extending in the left-right direction.

(2) Transfer Roller

The transfer roller 19 includes a transfer roller shaft 33 and a transfer roller body 34.

The transfer roller shaft 33 is made of metal and has a substantially cylindrical shape extending in the left-right direction.

The transfer roller body 34 is made of an elastic material such as conductive resin. The transfer roller body 34 has a substantially cylindrical shape extending in the left-right direction and covers the transfer roller shaft 33 so that left and right end portions of the transfer roller shaft 33 are exposed.

(3) Drum Cleaning Roller

The drum cleaning roller 9 includes a drum cleaning roller shaft 35 and a drum cleaning roller body 36.

The drum cleaning roller shaft 35 is made of metal and has a substantially cylindrical shape extending in the left-right direction.

The drum cleaning roller body 36 is formed of a foamed material such as semi-conducting silicon resin and urethane resin. The drum cleaning roller body 36 has a substantially cylindrical shape extending in the left-right direction and is configured to cover the drum cleaning roller shaft 35 such that left and right end portions of the drum cleaning roller shaft 35 are exposed.

3. Electrical Configuration of Printer

As shown in FIG. 2, the body casing 2 is provided therein with a control unit 41, which is an example of the control device for controlling operations of the printer 1, and a sensor 40.

The control unit 41 includes a power supply substrate 42 and a CPU 43.

The power supply substrate 42 includes a power supply 44, a charging circuit 45 configured to feed power to the scorotron-type charger 12, a transfer circuit 46 configured to feed power to the transfer roller 19 and a drum cleaning circuit 47 configured to feed power to the drum cleaning roller 9.

The power supply 44 is electrically coupled to the charging circuit 45, the transfer circuit 46 and the drum cleaning circuit 47 through a wiring in the power supply substrate 42.

The charging circuit 45 is electrically coupled to the grid 31 and charging wire 32 of the scorotron-type charger 12 through a wiring. The charging circuit 45 is configured to adjust a voltage, which is supplied from the power supply 44, to a predetermined voltage, based on control of the CPU 43, and then apply the voltage to the grid 31 and charging wire 32 of the scorotron-type charger 12.

The transfer circuit 46 is electrically coupled to the transfer roller shaft 33 of the transfer roller 19 through a wiring. The transfer circuit 46 is configured to adjust a voltage, which is supplied from the power supply 44, to a predetermined transfer bias, based on control of the CPU 43, and then apply the voltage to the transfer roller shaft 33.

The drum cleaning circuit 47 is electrically coupled to the drum cleaning roller shaft 35 of the drum cleaning roller 9 through a wiring. The drum cleaning circuit 47 is configured to adjust a voltage, which is supplied from the power supply 44, to a predetermined drum cleaning bias, based on control of the CPU 43, and then apply the voltage to the drum cleaning roller shaft 35.

The CPU 43 is electrically coupled to the charging circuit 45, the transfer circuit 46 and the drum cleaning circuit 47 through a signal wiring.

The sensor 40 is disposed at the front of the black photosensitive drum 11K that is arranged at the most forward side. The sensor 40 is electrically coupled to the CPU 43 through a signal wiring. The sensor 40 is comprised of an optical sensor, a mechanical sensor having an actuator or the like. The sensor 40 is configured to detect that a leading end (a downstream end portion in the conveyance direction) and a trailing end (an upstream end portion in the conveyance direction) of the sheet P pass between the black photosensitive drum 11K and the black transfer roller 19K, and transmits a detection signal to the CPU 43.

4. Image Forming Operation (1) Color Mode

As shown in FIG. 1, when forming a color image on the sheet P, all the developing rollers 13 are brought into contact with the corresponding photosensitive drums 11 and the printer 1 is switched into a color mode.

(1-1) Power Feeding

When the image forming operation is performed at the color mode, the control unit 41 applies a predetermined voltage to the charging wires 32 and grids 31 of all the scorotron-type chargers 12, respectively.

More specifically, the surface of the black photosensitive drum 11K is charged to a charging potential of +820V, for example, before it is exposed by the scanner unit 5.

Further, the surface of the yellow photosensitive drum 11Y is charged to a charging potential of +820V, for example, before it is exposed by the scanner unit 5.

Further, the surfaces of the magenta photosensitive drum 11M and the cyan photosensitive drum 11C are charged to a charging potential of +820V, which is an example of the third charging bias V3, before they are exposed by the scanner unit 5.

Thereby, the surfaces of all the photosensitive drums 11 are charged to the charging potential of +820V, for example, before they are exposed by the scanner unit 5.

Incidentally, the charging potentials of the photosensitive drums 11 are adjusted such that they are not negative when the transfer current is supplied.

Also, the control unit 41 applies a transfer bias (negative polarity) to the transfer rollers 19, respectively. Incidentally, the control unit 41 controls the transfer bias (constant current control) such that the transfer current flowing between the photosensitive drums 11 and the corresponding transfer rollers 19 is kept constant.

Thereby, for example, the transfer current of −11 μA flows between the black photosensitive drum 11K and the black transfer roller 19K.

Further, for example, the transfer current of −8 μA flows between the yellow photosensitive drum 11Y and the yellow transfer roller 19Y.

Further, for example, the transfer current of −10 μA (which is an example of the third transfer current) flows between the magenta photosensitive drum 11M and the magenta transfer roller 19M and between the cyan photosensitive drum 11C and the cyan transfer roller 19C.

Further, the control unit 41 applies a drum cleaning bias of −300V, for example, to each of the drum cleaning rollers 9K, 9Y, 9M, 9C.

(1-2) Transfer Operation

At the color mode, when the image forming operation is executed for a plurality of (e.g., two) sheets that is continuously conveyed, the toner images carried on the photosensitive drums 11 are transferred to the sheet P at the time that each sheet P passes through parts where the photosensitive drums 11 face the transfer rollers 19.

In the meantime, the toner that has not been transferred to the sheet P may remain on circumferential surfaces of the photosensitive drums 11.

The transfer remaining toner on the circumferential surface of the photosensitive drum 11 faces the drum cleaning roller 9 as the photosensitive drum 11 is rotated (rotation in a counterclockwise direction, when seen from the right side). Then, the transfer remaining toner is electrostatically held on the circumferential surface of the drum cleaning roller 9 by the drum cleaning bias.

(2) Monochrome Mode

As shown in FIG. 2, when forming a monochrome image on the sheet P, the black developing roller 13 is brought into contact with the black photosensitive drum 11K, and the developing rollers 13 of colors (yellow, magenta and cyan) are separated from the corresponding photosensitive drums 11 by a well-known separation mechanism and the printer 1 is switched into a monochrome mode.

(2-1) Power Feeding

When the image forming operation is performed at the monochrome mode, the surface of the black photosensitive drum 11K is charged to a charging potential of +760V, which is an example of the first charging bias V1, before it is exposed by the scantier unit 5.

Further, the surface of the yellow photosensitive drum 11Y is charged to a charging potential of +760V, which is an example of the fifth charging bias V5.

Further, the surfaces of the magenta photosensitive drum 11M and the cyan photosensitive drum 11C are charged to a charging potential of +400V, which is an example of the fourth charging bias V4, for a time period corresponding to a sheet interval, and are charged to a charging potential of +100V, which is an example of the second charging bias V2, for the other time periods.

Incidentally, the time period corresponding to a sheet interval means a time period corresponding to an interval between a sheet to be printed first (for example, first sheet P1 that will be described later) and a sheet to be printed next time (for example, second sheet P2 that will be described later).

Further, for example, the transfer current of −11 μA flows between the black photosensitive drum 11K and the black transfer roller 19K.

Further, for example, the transfer current of −8 μA (which is an example of the fifth transfer current) flows between the yellow photosensitive drum 11Y and the yellow transfer roller 19Y.

Further, for example, the transfer current of −3 μA (which is an example of the first transfer current) flows between the magenta photosensitive drum 11M and the magenta transfer roller 19M and between the cyan photosensitive drum 11C and the cyan transfer roller 19C.

Further, the control unit 41 applies a drum cleaning bias of −300V, for example, to each of the drum cleaning rollers 9K, 9Y, 9M, 9C.

(2-2) Transfer Operation

Here, the transfer operation that is performed at the monochrome mode for a plurality of (two) sheets that is continuously conveyed is described.

When the image forming operation is executed, a leading end of a first sheet P1 (an example of the first sheet) is fed to a part (first nip) where the black photosensitive drum 11K faces the black transfer roller 19K.

Figure 6:
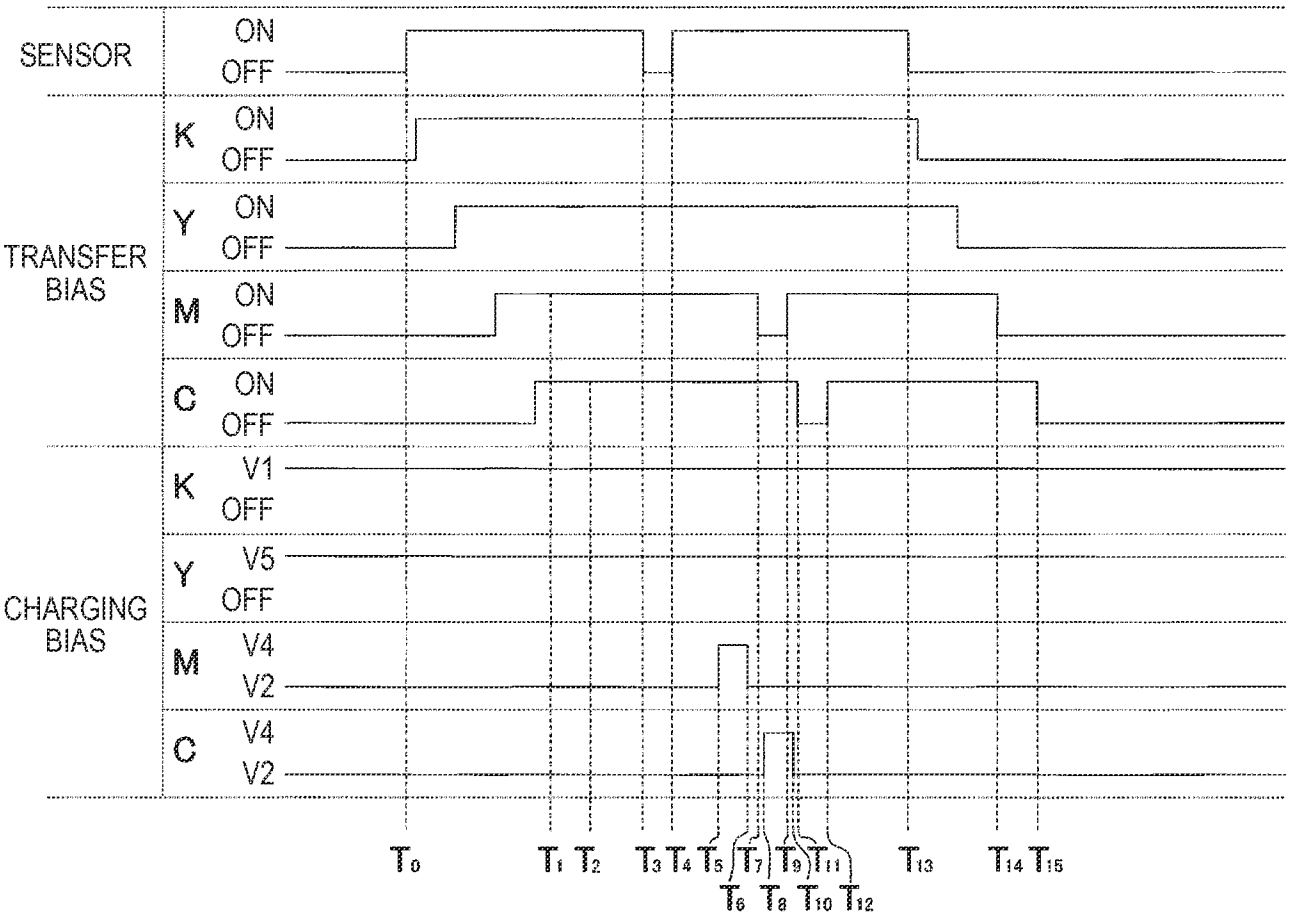
FIG. 6 is a timing chart showing an ON/OFF switching of a transfer bias in a case where an image is formed at the monochrome mode.

Then, the sensor 40 detects that the leading end of the first sheet P1 passes ($T_0$ in FIG. 6).

Then, when the leading end of the first sheet P1 is detected by the sensor 40, the transfer bias is applied to the black transfer roller 19K.

Then, when an image forming area I of the sheet P1 passes through the part (first nip) where the black photosensitive drum 11K faces the black transfer roller 19K, a black toner image is transferred to the image forming area I of the first sheet P1.

Incidentally, the image forming area I is defined in the sheet P (the first sheet P1, the second sheet P2 (which will be described later)) such that predetermined margins are formed from peripheral edges from front to back and from side to side.

Then, the leading end of the first sheet P1 passes through a part (third nip) where the yellow photosensitive drum 11Y faces the yellow transfer roller 19Y, and a part (second nip) where the magenta photosensitive drum 11M faces the magenta transfer roller 19M ($T_1$ in FIG. 6). Then, the leading end of the first sheet P1 passes a part (second nip) where the cyan photosensitive drum 11C faces the cyan transfer roller 19C ($T_2$ in FIG. 6).

Incidentally, just after the leading end of the first sheet P1 passes through the part where the cyan photosensitive drum 11C faces the cyan transfer roller 19C, the sensor 40 detects that the trailing end of the first sheet P1 passes ($T_3$ in FIG. 6).

After that, as shown in FIGS. 2 and 6, following the first sheet P1, a second sheet P2 that is an example of the second sheet is fed to the part where the black photosensitive drum 11K faces the black transfer roller 19K.

At this time, the sensor 40 detects that a leading end of the second sheet P2 passes ($T_4$ in FIG. 6).

Figure 3:
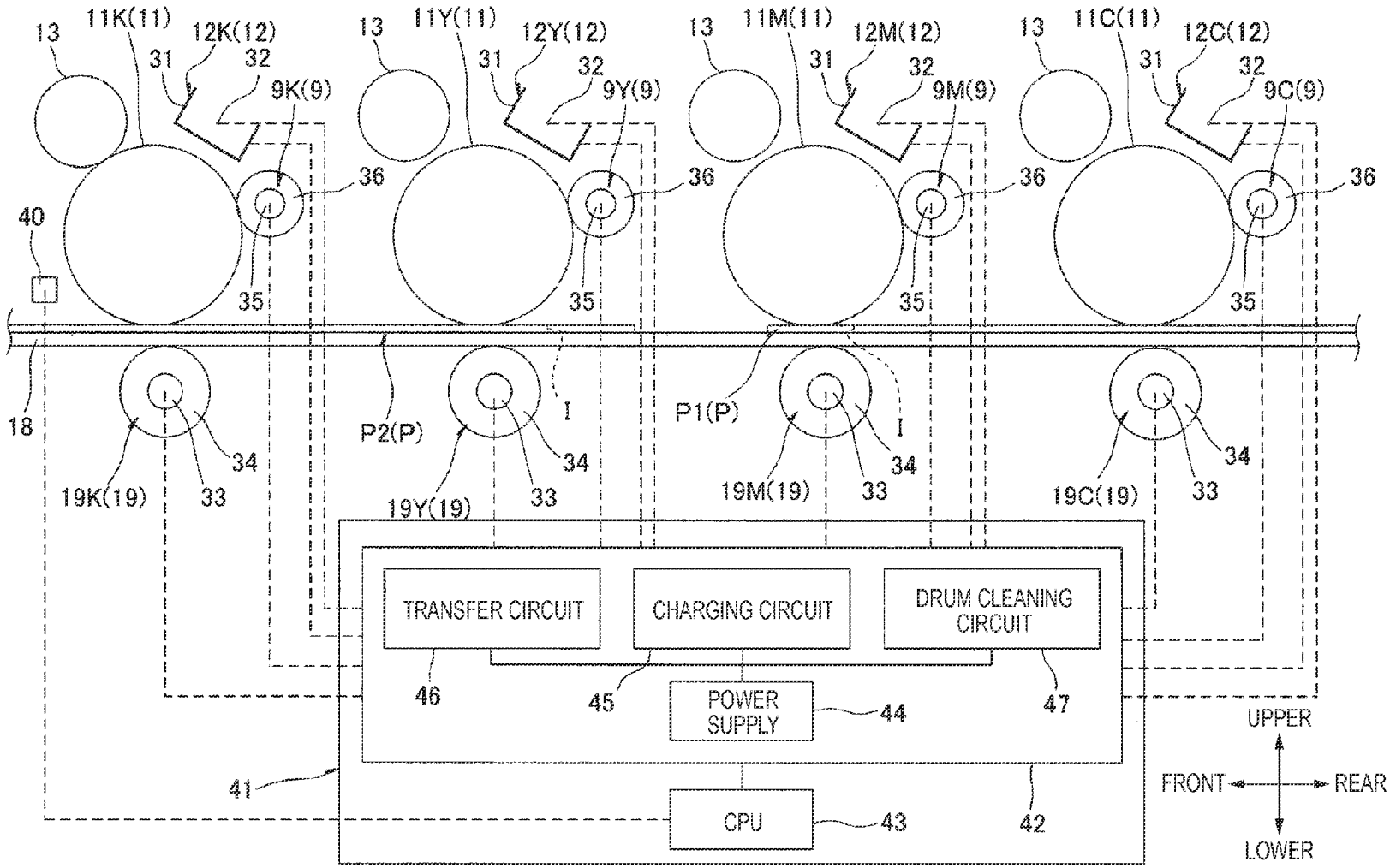
FIG. 3 shows a case where an image is formed at the monochrome mode, illustrating an aspect where a trailing end portion of the first sheet passes between a magenta photosensitive drum and a magenta transfer roller.

Then, as shown in FIGS. 3 and 6, the control unit 41 turns off the applying of the transfer bias to the magenta transfer roller 19M when a trailing end portion (a part between a trailing end of the image forming area I and the trailing end of the sheet P1) of the first sheet P1 passes through the part where the magenta photosensitive drum 11M faces the magenta transfer roller 19M ($T_7$ in FIG. 6) ($T_1$ to $T_7$ in FIG. 6 corresponds to the first time period).

Thereby, the transfer current does not flow between the magenta photosensitive drum 11M and the magenta transfer roller 19M. That is, the second transfer current is zero (0).

Incidentally, the time ($T_7$) at which the applying of the transfer bias to the magenta transfer roller 19M is turned off is set as time at which the trailing end of the first sheet P1 contacts the magenta photosensitive drum 11M, based on the time ($T_3$) at which the trailing end of the sheet P1 is detected by the sensor 40. Specifically, the time ($T_7$) at which the applying of the transfer bias to the magenta transfer roller 19M is turned off is set as 1.5 seconds later from the time ($T_3$) at which the trailing end of the sheet P1 is detected by the sensor 40.

Further, when the image forming area I of the first sheet P1 is passing through the part where the magenta photosensitive drum 11M faces the magenta transfer roller 19M, the control unit 41 continues to apply the transfer bias to the magenta transfer roller 19M.

Further, even after the trailing end of the first sheet P1 passes through the part where the black photosensitive drum 11K faces the black transfer roller 19K and the part where the yellow photosensitive drum 11Y faces the yellow transfer roller 19Y, the control unit 41 continues to apply the transfer bias to the black transfer roller 19K and the yellow transfer roller 19Y.

That is, the control unit 41 continues to supply the transfer current of −8 μA (which is an example of the fifth transfer current) for a time period (third time period) during which the first sheet P1 passes through the part where the yellow photosensitive drum 11Y faces the yellow transfer roller 19Y and for a time period (fourth time period) corresponding to the sheet interval.

At this time, a leading end of the second sheet P2 passes through the part where the yellow photosensitive drum 11Y faces the yellow transfer roller 19Y and is conveyed to the front of the part where the magenta photosensitive drum 11M faces the magenta transfer roller 19M. Like the image forming area I of the first sheet P1, a black toner image is transferred to the image forming area I of the second sheet P2 when the second sheet passes through the part where the black photosensitive drum 11K faces the black transfer roller 19K.

Figure 4:
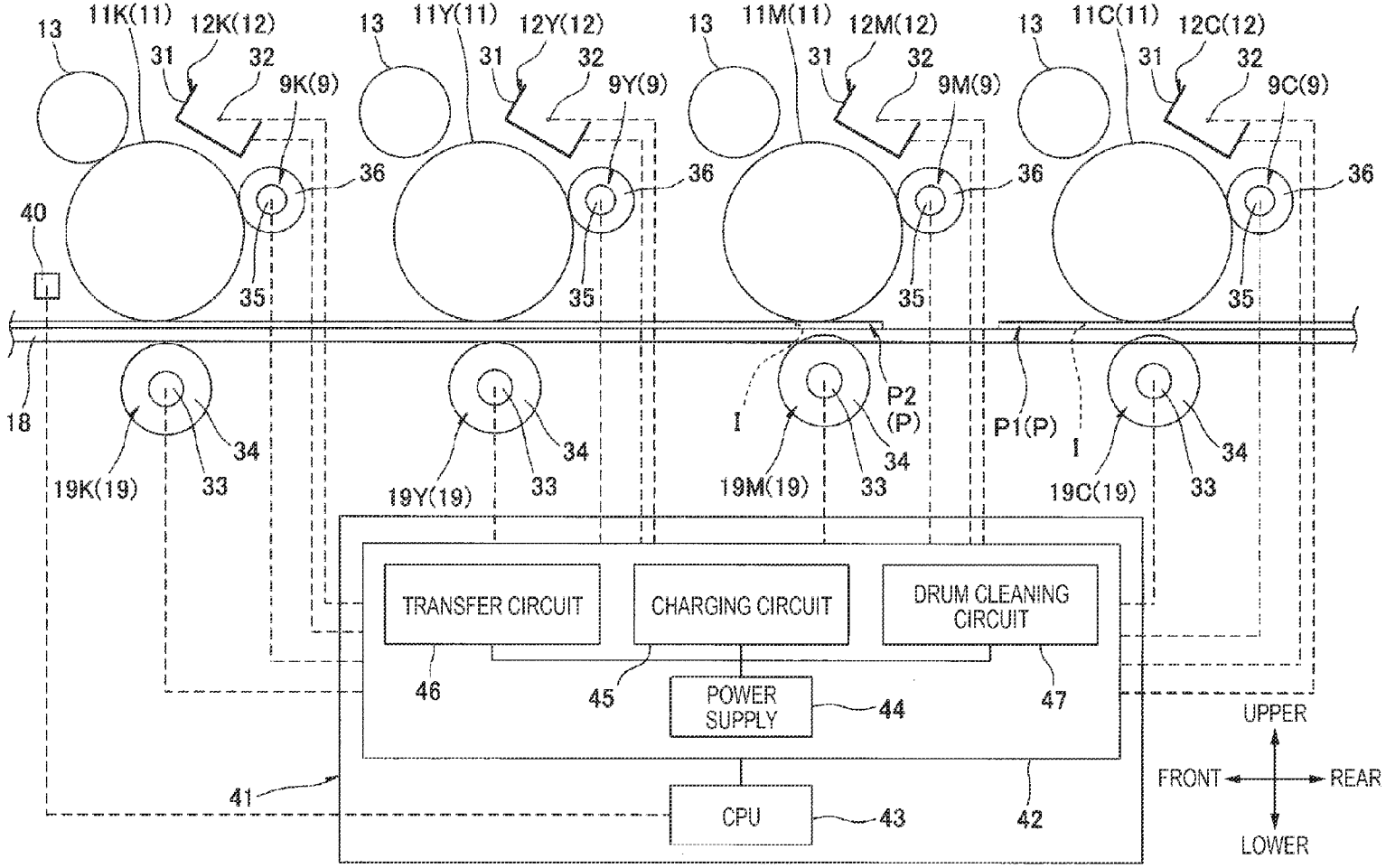
FIG. 4 shows a case where an image is formed at the monochrome mode, illustrating an aspect where a leading end portion of the second sheet passes between the magenta photosensitive drum and the magenta transfer roller.

Then, as shown in FIGS. 4 and 6, the control unit 41 turns on the applying of the transfer bias to the magenta transfer roller 19M when a leading end portion (a part between the leading end of the sheet P2 and a leading end of the image forming area I) of the second sheet P2 passes through the part where the magenta photosensitive drum 11M faces the magenta transfer roller 19M ($T_9$ in FIG. 6) ($T_7$ to $T_9$ in FIG. 6 corresponds to the second time period). The transfer current of −3 μA (first transfer current) flows between the magenta photosensitive drum 11M and the magenta transfer roller 19M.

Incidentally, the time ($T_9$) at which the applying of the transfer bias to the magenta transfer roller 19M is turned on is set as time at which the leading end of the second sheet P2 contacts the magenta photosensitive drum 11M, based on the time ($T_4$) at which the leading end of the sheet P2 is detected by the sensor 40.

Figure 5:
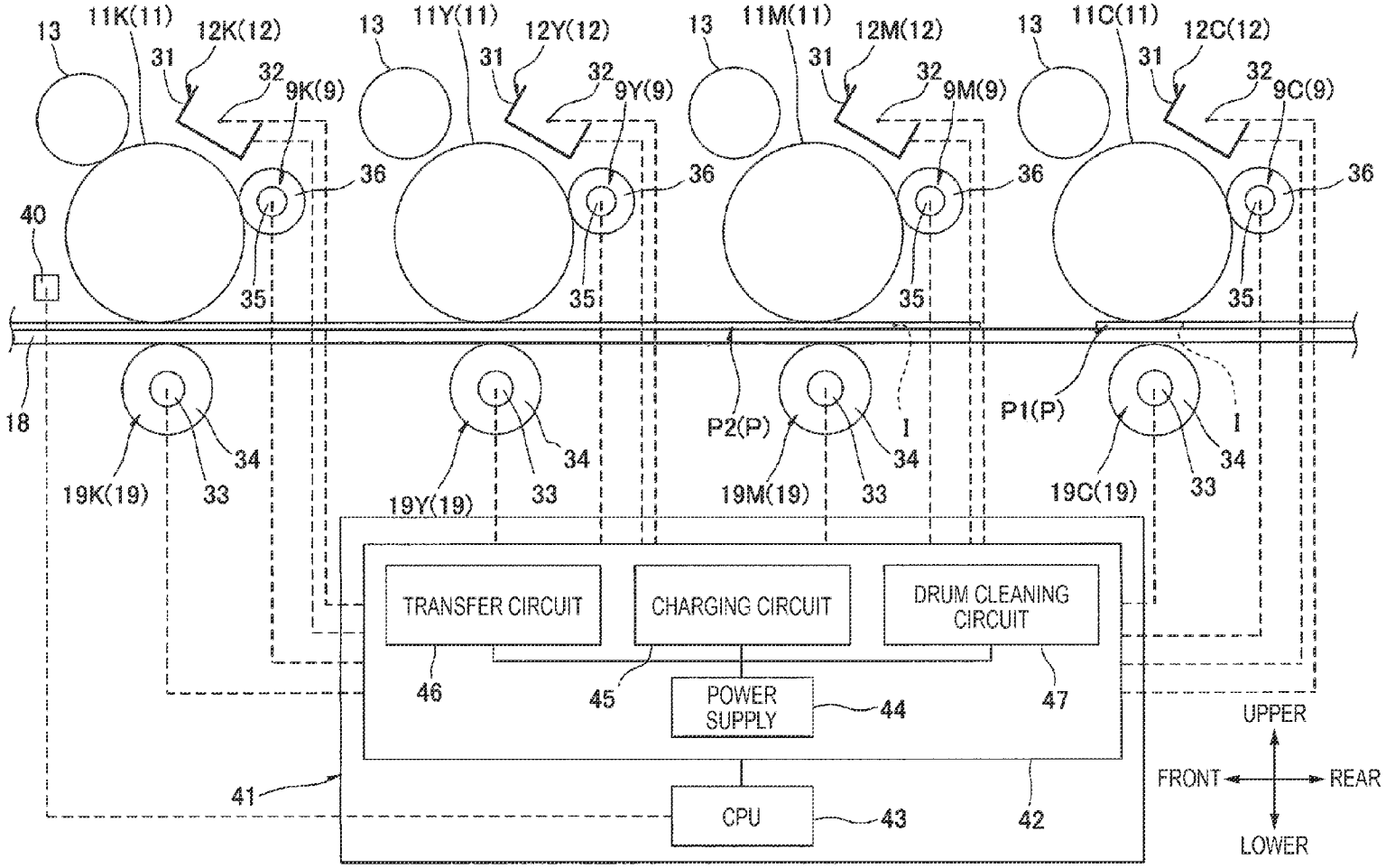
FIG. 5 shows a case where an image is formed at the monochrome mode, illustrating an aspect where the trailing end portion of the first sheet passes between a cyan photosensitive drum and a cyan transfer roller.

Then, as shown in FIGS. 5 and 6, the control unit 41 turns off the applying of the transfer bias to the cyan transfer roller 19C when a trailing end portion (a part between the trailing end of the image forming area I and the trailing end of the sheet P1) of the first sheet P1 passes through the part where the cyan photosensitive drum 11C faces the cyan transfer roller 19C ($T_{11}$ in FIG. 6) ($T_2$ to $T_{11}$ in FIG. 6 corresponds to the first time period).

Thereby, the transfer current does not flow between the cyan photosensitive drum 11C and the cyan transfer roller 19C. That is, the second transfer current becomes zero (0).

Incidentally, the time ($T_{11}$) at which the applying of the transfer bias to the cyan transfer roller 19C is turned off is set as time at which the trailing end of the sheet P1 contacts the cyan photosensitive drum 11C, based on the time ($T_3$) at which the trailing end of the sheet P1 is detected by the sensor 40.

Further, before the image forming area I of the first sheet P1 passes through the part where the cyan photosensitive drum 11C faces the cyan transfer roller 19C, the control unit 41 continues to apply the transfer bias to the cyan transfer roller 19C.

After that, as shown in FIG. 6, the control unit 41 turns on the applying of the transfer bias to the cyan transfer roller 19C when the leading end portion (the part between the leading end of the sheet P2 and the leading end of the image forming area I) of the second sheet P2 passes through the part where the cyan photosensitive drum 11C faces the cyan transfer roller 19C ($T_{12}$ in FIG. 6) ($T_{11}$ to $T_{12}$ in FIG. 6 corresponds to the second time period). The transfer current of −3 μA (first transfer current) flows between the cyan photosensitive drum 11C and the cyan transfer roller 19C.

Incidentally, the time ($T_{12}$) at which the applying of the transfer bias to the cyan transfer roller 19C is turned on is set as time at which the leading end of the second sheet P2 contacts the cyan photosensitive drum 11C, based on the time ($T_4$) at which the leading end of the sheet P2 is detected by the sensor 40.

Then, after the sensor 40 detects that the trailing end of the second sheet P2 passes ($T_{13}$ in FIG. 6) and then the trailing end of the second sheet P2 passes through the part where the black photosensitive drum 11K faces the black transfer roller 19K, the control unit 41 turns off the applying of the transfer bias to the black transfer roller 19K. Then, after the trailing end of the second sheet P2 passes through the part where the yellow photosensitive drum 11Y faces the yellow transfer roller 19Y, the control unit 41 turns off the applying of the transfer bias to the yellow transfer roller 19Y.

Further, when the trailing end of the second sheet P2 passes through the part where the magenta photosensitive drum 11M faces the magenta transfer roller 19M ($T_{14}$ in FIG. 6), the control unit 41 turns off the applying of the transfer bias to the magenta transfer roller 19M ($T_9$ to $T_{14}$ in FIG. 6 corresponds to the first time period).

Further, when the trailing end of the second sheet P2 passes through the part where the cyan photosensitive drum 11C faces the cyan transfer roller 19C ($T_{15}$ in FIG. 6), the control unit 41 turns off the applying of the transfer bias to the cyan transfer roller 19C ($T_{12}$ to $T_{15}$ in FIG. 6 corresponds to the first time period).

With this, the transfer operation for the two sheets that are continuously conveyed is completed.

(2-3) Charging Operation

Here, the charging operation that is executed in conjunction with the above transfer operation is described reference to FIG. 6.

Just before tinning off the applying of the transfer bias to the magenta transfer roller 19M ($T_7$ in FIG. 6), the control unit 41 controls the scorotron-type charger 12M to adjust the charging bias of the magenta photosensitive drum 11M to the fourth charging bias (±400V) ($T_5$ in FIG. 6).

Then, after the time period corresponding to the sheet interval elapses, the control unit 41 controls the scorotron-type charger 12M to adjust the charging bias of the magenta photosensitive drum 11M to the second charging bias (+100V) ($T_6$ in FIG. 6). That is, $T_5$ to $T_6$ in FIG. 6 corresponds to the sheet interval.

Specifically, the time ($T_5$) at which the charging bias of the magenta photosensitive drum 11M is changed from the second charging bias V2 to the fourth charging bias V4 is set as time that is obtained by subtracting a circulating tune period (for example, 0.35 second) of the magenta photosensitive drum 11M in the counterclockwise direction from a part facing the scorotron-type charger 12M to the second nip, when seen from the right side, and one circulating time period (for example, 0.6 second) of the magenta photosensitive drum 11M from the time ($T_9$) at which the leading end of the second sheet P2 passes through the part where the magenta photosensitive drum 11M faces the magenta transfer roller 19M, based on the time ($T_4$) at which the leading end of the second sheet P2 is detected by the sensor 40.

Further, the time ($T_6$) at which the charging bias of the magenta photosensitive drum 11M is changed from the fourth charging bias V4 to the second charging bias V2 is set as time that is obtained by subtracting the circulating time period (for example, 0.35 second) of the magenta photosensitive drum 11M in the counterclockwise direction from the part facing the scorotron-type charger 12M to the second nip, when seen from the right side, from the time ($T_9$) at which the leading end of the second sheet P2 passes through the part where the magenta photosensitive drum 11M faces the magenta transfer roller 19M, based on the time ($T_4$) at which the leading end of the second sheet P2 is detected by the sensor 40.

Further, just before turning off the applying of the transfer bias to the cyan transfer roller 19C ($T_{11}$ in FIG. 6), the control unit 41 controls the scorotron-type charger 12C to adjust the charging bias of the cyan photosensitive drum 11C to the fourth charging bias (+400V) ($T_8$ in FIG. 6).

Then, after the time period corresponding to the sheet interval elapses, the control unit 41 controls the scorotron-type charger 12C to adjust the charging bias of the cyan photosensitive drum 11C to the second charging bias (−100V) ($T_{10}$ in FIG. 6). That is, $T_8$ to $T_{10}$ in FIG. 6 corresponds to the sheet interval.

Specifically, the time ($T_8$) at which the charging bias of the cyan photosensitive drum 11C is changed from the second charging bias V2 to the fourth charging bias V4 is set as time that is obtained by subtracting a circulating time period (for example, 0.35 second) of the cyan photosensitive drum 11C in the counterclockwise direction from a part facing the scorotron-type charger 12C to the second nip, when seen from the right side, and one circulating time period (for example, 0.6 second) of the cyan photosensitive drum 11C from the time ($T_{12}$) at which the leading end of the second sheet P2 passes through the part where the cyan photosensitive drum 11C faces the cyan transfer roller 19C, based on the time ($T_4$) at which the leading end of the second sheet P2 is detected by the sensor 40.

Further, the time ($T_{10}$) at which the charging bias of the cyan photosensitive drum 11C is changed from the fourth charging bias V4 to the second charging bias V2 is set as time that is obtained by subtracting the circulating time period (for example, 0.35 second) of the cyan photosensitive drum 11C in the counterclockwise direction from the part facing the scorotron-type charger 12C to the second nip, when seen from the right side, from the time ($T_{12}$) at which the leading end of the second sheet P2 passes through the part where the cyan photosensitive drum 11C faces the cyan transfer roller 19C, based on the time ($T_4$) at which the leading end of the second sheet P2 is detected by the sensor 40.

4. Advantages (1) According to the printer 1, as shown in FIG. 6, when the first sheet P1 is passing through the part where the magenta photosensitive drum 11M (or cyan photosensitive drum 11C) faces the magenta transfer roller 19M (or cyan transfer roller 19C), the control unit 41 supplies the transfer current of −3 μA and does not supply the transfer current (that is, the transfer current becomes zero) between the magenta photosensitive drum 11M (or cyan photosensitive drum 11C) and the magenta transfer roller 19M (or cyan transfer roller 19C) for the sheet interval ($T_7$ to $T_9$ or $T_{11}$ to $T_{12}$ in FIG. 6) between the first sheet P1 and the second sheet P2.

Therefore, when printing the plurality of sheets (sheet P1 and sheet P2), which is continuously conveyed, at the monochrome mode, it is possible to suppress the power consumption of the magenta process unit 6M and the cyan process unit 6C.

As a result, it is possible to suppress the power consumption of the printer 1.

(2) Further, according to the printer 1, when performing the image forming operation for the plurality of sheets (e.g., two sheets), which is continuously conveyed, at the color mode, the control unit 41 supplies the transfer current of −10 μA between the magenta photosensitive drum 11M (or cyan photosensitive drum 11C) and the magenta transfer roller 19M (or cyan transfer roller 19C) for the time period ($T_1$ to $T_7$, $T_9$ to $T_{14}$, $T_2$ to $T_{11}$, $T_{12}$ to $T_{15}$ in FIG. 6) during which the first sheet P1 passes through the part where the magenta photosensitive drum 11M (or cyan photosensitive drum 11C) faces the magenta transfer roller 19M (or cyan transfer roller 19C).

That is, it is possible to set the transfer current (−3 μA), which is supplied between the magenta photosensitive drum 11M (or can photosensitive drum 11C) and the magenta transfer roller 19M (or cyan transfer roller 19C) during the continuous printing at the monochrome mode, to be smaller than the transfer current (−10 μA) during the continuous printing at the color mode.

Therefore, it is possible to further suppress the power consumption of the magenta process unit 6M and the cyan process unit 6C during the continuous printing at the monochrome mode.

(3) Further, according to the printer 1, when forming an image at the monochrome mode, it is possible to set the charging potential (+100V) of the magenta photosensitive drum 11M and the cyan photosensitive drum 11C to be lower than the charging potential (+760V) of the black photosensitive drum 11K.

Therefore, it is possible to further suppress the power consumption of the magenta process unit 6M and the cyan process unit 6C during the continuous printing at the monochrome mode.

(4) Also, according to the printer 1, when forming an image at the monochrome mode, the control unit 41 controls the charging potential such that the charging potential (+100V) of the magenta photosensitive drum 11M and the cyan photosensitive drum 11C is lower than the charging potential (+820V) of the magenta photosensitive drum 11M and the cyan photosensitive drum 11C when forming an image at the color mode.

Hence, it is possible to further suppress the power consumption of the magenta process unit 6M and the cyan process unit 6C during the continuous printing at the monochrome mode.

(5) Further, according to the printer 1, as shown in FIG. 1, each process unit 6 includes the drum cleaning roller 9 configured to hold the transfer remaining toner attached on the surface of the photosensitive drum 11.

In this case, if the transfer current continues to flow between the magenta photosensitive drum 11M (or cyan photosensitive drum 11C) and the magenta transfer roller 19M (or cyan transfer roller 19C) for the sheet interval between the first sheet P1 and the second sheet P2, the current may excessively flow between the magenta photosensitive drum 11M (or cyan photosensitive drum 11C) and the magenta transfer roller 19M (or cyan transfer roller 19C) when the first sheet P1 passes. Then, due to the current, the charging potential of the magenta photosensitive drum 11M (or cyan photosensitive drum 11C) may vary with respect to the charged polarity of the toner, so that the transfer remaining toner collected by the drum cleaning roller 9 may be again attached to the magenta photosensitive drum 11M (or cyan photosensitive drum 11C).

However, according to the printer 1, as described above and as shown in FIG. 6, the transfer current flowing to the part where the magenta photosensitive drum 11M (or cyan photosensitive drum 11C) faces the magenta transfer roller 19M (or cyan transfer roller 19C) is reduced for the sheet interval ($T_7$ to $T_9$ or $T_{11}$ to $T_{12}$ in FIG. 6) between the first sheet P1 and the second sheet P2.

Therefore, it is possible to suppress the current from excessively flowing between the magenta photosensitive drum 11M (or cyan photosensitive drum 11C) and the magenta transfer roller 19M (or cyan transfer roller 19C) for the sheet interval between the first sheet P1 and the second sheet P2.

As a result, it is possible to suppress the charged polarity of the magenta photosensitive drum 11M (or cyan photosensitive drum 11C) from being varied, so that it is possible to suppress the transfer remaining toner collected by the drum cleaning roller 9 from being again attached to the magenta photosensitive drum 11M (or cyan photosensitive drum 11C).

(6) Further, according to the printer 1, as shown in FIG. 6, the charging potential of the magenta photosensitive drum 11M (or cyan photosensitive drum 11C) is beforehand increased from +100V to ±400V for the time period ($T_5$ to $T_6$ or $T_8$ to $T_{10}$ in FIG. 6) corresponding to the sheet interval ($T_7$ to $T_9$ or $T_{11}$ to $T_{12}$ in FIG. 6) between the first sheet P1 and the second sheet P2.

Therefore, it is possible to prevent the current from excessively flowing between the magenta photosensitive drum 11M (or cyan photosensitive drum 11C) and the magenta transfer roller 19M (or cyan transfer roller 19C) for the sheet interval ($T_7$ to $T_9$ or $T_{11}$ to $T_{12}$ in FIG. 6) between the first sheet P1 and the second sheet P2.

As a result, it is possible to securely suppress the transfer remaining toner collected by the drum cleaning roller 9 from being again attached to the magenta photosensitive drum 11M (or cyan photosensitive drum 11C).

(7) Further, according to the printer 1, as shown in FIG. 1, the scorotron-type chargers 12 are provided.

Therefore, it is possible to reduce the ozone to be generated.

(8) Further, according to the printer 1, as shown in FIG. 1, the black process unit 6K is disposed at the more forward side (at the more upstream side in the conveyance direction of the sheet P) than the magenta process unit 6M and the cyan process unit 6C.

Therefore, the toner image that is formed on the sheet P by the black process unit 6K may be reversely transferred to the magenta photosensitive drum 11M or cyan photosensitive drum 11C.

However, according to the printer 1, as described above and as shown in FIG. 6, the transfer current of −3 μA is supplied between the magenta photosensitive drum 11M (or cyan photosensitive drum 11C) and the magenta transfer roller 19M (or cyan transfer roller 19C) for the time period ($T_1$ to $T_7$, $T_9$ to $T_{14}$, $T_2$ to $T_{11}$, $T_{12}$ to $T_{15}$ in FIG. 6) during which the first sheet and the second sheet P2 pass through the part where the magenta photosensitive drum 11M (or cyan photosensitive drum 11C) faces the magenta transfer roller 19M (or cyan transfer roller 19C).

Therefore, it is possible to suppress the toner image, which is formed on the sheet P by the black process unit 6K, from being reversely transferred to the magenta photosensitive drum 11M or cyan photosensitive drum 11C.

(9) Further, according to the printer 1, as shown in FIG. 6, when forming an image at the monochrome mode, the control unit 41 controls the yellow scorotron-type charger 12Y to charge the yellow photosensitive drum 11Y to the charging potential (+760V) higher than the charging potential (+100V) of the magenta photosensitive drum 11M (or cyan photosensitive drum 11C).

Therefore, it is possible to suppress the toner image, which is formed on the sheet P by the black process unit 6K, from being reversely transferred to the yellow photosensitive drum 11Y by the charging potential of the yellow photosensitive drum 11Y.

(10) Further, according to the printer 1, as shown in FIG. 6, it is possible to always supply the transfer current of −8 μA to the part where the yellow photosensitive drum 11Y faces the yellow transfer roller 19Y at the monochrome mode.

Therefore, it is possible to further suppress the toner image, which is formed on the sheet P by the black process unit 6K, from being reversely transferred to the yellow photosensitive drum 11Y.

(11) Further, according to the printer 1, as shown in FIGS. 3 and 5, before the trailing end of the first sheet P1 passes through the part where the magenta photosensitive drum 11M (or cyan photosensitive drum 11C) faces the magenta transfer roller 19M (or cyan transfer roller 19C) ($T_7$ or $T_{11}$ in FIG. 6), it is possible to securely reduce the transfer current between the magenta photosensitive drum 11M (or cyan photosensitive drum 11C) and the magenta transfer roller 19M (or cyan transfer roller 19C).

(12) Further, according to the printer 1, as shown in FIG. 4, when the leading end of the second sheet P2 passes through the part where the magenta photosensitive drum 11M (or cyan photosensitive drum 11C) faces the magenta transfer roller 19M (or cyan transfer roller 19C) ($T_9$ or $T_{12}$ in FIG. 6), the control unit 41 supplies the transfer current of −3 μA between the magenta photosensitive drum 11M (or cyan photosensitive drum 11C) and the magenta transfer roller 19M (or cyan transfer roller 19C).

Therefore, it is possible to securely suppress the toner image, which is formed in the image forming area I on the sheet P by the black process unit 6K, from being reversely transferred to the magenta photosensitive drum 11M (or cyan photosensitive drum 11C).

5. Second Exemplary Embodiment

A second exemplary embodiment of the printer 1 will be described with reference to FIG. 7. Incidentally, in the second exemplary embodiment, the same members as those of the first exemplary embodiment are denoted with the same reference numerals and the descriptions thereof are omitted.

In the first exemplary embodiment, the photosensitive drum 11 is charged by the scorotron-type charger 12.

Figure 7:
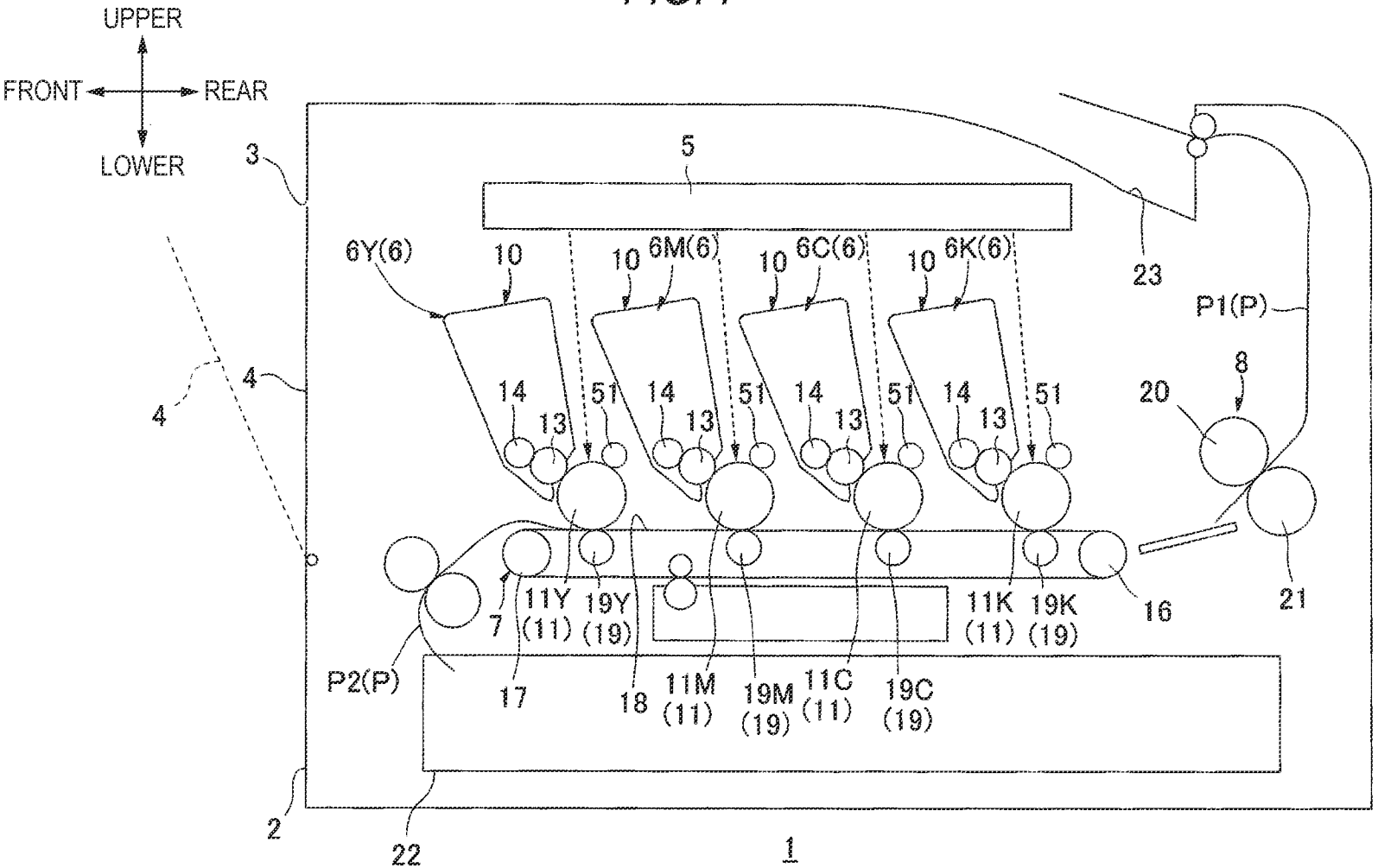
FIG. 7 illustrates a second exemplary embodiment of the invention.

Compared to the first exemplary embodiment, in the second exemplary embodiment, the photosensitive drum 11 is charged by a charging roller 51, as shown in FIG. 7.

Further, in the first exemplary embodiment, the respective process units 6 are arranged in parallel at an interval in order of black, yellow, magenta and cyan from the front side (the upstream side in the conveyance direction) towards the rear side (the downstream side in the conveyance direction).

On the other hand, in the second exemplary embodiment, the respective process units 6 are arranged in parallel at an interval in order of yellow, magenta, cyan and black from the front side (the upstream side in the conveyance direction) towards the rear side (the downstream side in the conveyance direction).

Specifically, the four charging rollers 51 are provided such that they correspond to the plurality of (e.g., four) photosensitive drums 11, respectively. The charging roller 51 contacts the corresponding photosensitive drum 11 from the rear-upper side thereof. Incidentally, the charging roller 51 corresponding to the black photosensitive drum 11K is an example of the first charging member, the charging rollers 51 corresponding to the magenta photosensitive drum 11M and the cyan photosensitive drum 11C are an example of the second charging member, and the charging roller 51 corresponding to the yellow photosensitive drum 11Y is an example of the third charging member.

Further, when the charging roller 51 charges the corresponding photosensitive drum 11, the attachment attached on the surface of the corresponding photosensitive drum 11 may be electrostatically held on a surface of the charging roller 51. The attachment may include paper dust, reverse transfer remaining toner and the like.

That is, the charging roller 51 corresponding to the black photosensitive drum 11K also functions as the first holding member. The charging rollers 51 corresponding to the magenta photosensitive drum 11M and the cyan photosensitive drum 11C also function as the second holding member. The charging roller 51 corresponding to the yellow photosensitive drum 11Y also functions as the third holding member.

Also in the second exemplary embodiment, it is possible to realize the same operational effects as those of the first exemplary embodiment.

6. Modified Exemplary Embodiments (1) in the first exemplary embodiment, when the trailing end of the first sheet P1 passes between the magenta photosensitive drum 11M and the magenta transfer roller 19M, the applying of the transfer bias to the magenta transfer roller 19M is turned off.

Alternatively, when the trailing end of the first sheet P1 passes between the magenta photosensitive drum 11M and the magenta transfer roller 19M, the transfer bias that is applied to the magenta transfer roller 19M may be controlled such that an absolute value of the transfer current flowing between the magenta photosensitive drum 11M and the magenta transfer roller 19M is decreased.

In this case, when the trailing end portion of the first sheet P1 passes between the magenta photosensitive drum 11M and the magenta transfer roller 19M, the transfer current of −1 μA (second transfer current) is supplied between the magenta photosensitive drum 11M and the magenta transfer roller 19M, for example.

Also in this modified embodiment, it is possible to realize the same operational effects as those of the first exemplary embodiment.

(2) Further, in the above exemplary embodiments, the transfer operation that is performed for the two sheets P, which are continuously conveyed, has been described. Alternatively, even when the number of sheets, which are continuously conveyed, is larger such as three sheets and four sheets, the transfer operation and the charging operation can be performed for a sheet interval between a second sheet P and a third sheet P or for a sheet interval between a third sheet P and a fourth sheet P, like the above exemplary embodiments.

Also in this case, it is possible to realize the same operational effects as those of the above exemplary embodiments.

What is claimed is:

1. An image forming apparatus comprising:

a conveyance belt configured to convey a sheet;

a first image forming unit configured to form a monochrome image in a monochrome mode, and comprising:

a first photosensitive drum for black; and a first transfer unit configured to nip the conveyance belt with the first photosensitive drum so as to form a first nip;

a second image forming unit configured to form a color image in a color mode, and comprising:

a second photosensitive drum for a color other than black; and a second transfer unit configured to nip the conveyance belt with the second photosensitive drum so as to form a second nip; and a control device configured to control a transfer current flowing to the second nip, wherein the control device is configured to, when a first sheet and a second sheet are continuously conveyed in corresponding order by the conveyance belt in the monochrome mode:

supply a first transfer current for a first time period during which the first sheet or the second sheet pass through the second nip; and supply a second transfer current, which is smaller than the first transfer current, for a second time period that is a time interval between the first sheet and the second sheet, and wherein the control device is further configured to supply a third transfer current that is larger than the first transfer current for the first time period when the first sheet and the second sheet are continuously conveyed in corresponding order by the conveyance belt in the color mode.

2. The image forming apparatus according to claim 1, wherein the second transfer current is zero.

3. The image forming apparatus according to claim 1, wherein the first image forming unit comprises a first charging member configured to charge a surface of the first photosensitive drum, wherein the second image forming unit comprises a second charging member configured to charge a surface of the second photosensitive drum, and wherein the control device is configured to, when forming an image in the monochrome mode:

control the first charging member to charge the first photosensitive drum to a first charging bias; and control the second charging member to charge the second photosensitive drum to a second charging bias having an absolute value that is smaller than that of the first charging bias.

4. The image forming apparatus according to claim 3, wherein the control device is configured to, when forming an image in the monochrome mode, control the absolute value of the second charging bias to be smaller than an absolute value of a third charging bias that is a charging potential of the second photosensitive drum when forming an image in the color mode.

5. The image forming apparatus according to claim 3, wherein the first charging member and the second charging member are scorotron-type chargers.

6. The image forming apparatus according to claim 3, wherein the first image forming unit is disposed more upstream than the second image forming unit in a sheet conveyance direction.

7. The image forming apparatus according to claim 1, wherein the control device is configured to supply the second transfer current when a part of the first sheet between a trailing end of an image forming area defined in the first sheet and a trailing end of the first sheet passes through the second nip.

8. The image forming apparatus according to claim 1, wherein the control device is configured to supply the first transfer current when a part of the second sheet between a leading end of an image forming area defined in the second sheet and a leading end of the second sheet passes through the second nip.

9. An image forming apparatus comprising:

a conveyance belt configured to convey a sheet;

a first image forming unit configured to form a monochrome image in a monochrome mode, and comprising:

a first photosensitive drum for black;

a first transfer unit configured to nip the conveyance belt with the first photosensitive drum so as to form a first nip; and a first charging member configured to charge a surface of the first photosensitive drum;

a second image forming unit configured to form a color image in a color mode, and comprising:

a second photosensitive drum for a color other than black;

a second transfer unit configured to nip the conveyance belt with the second photosensitive drum so as to form a second nip;

a holding member configured to contact the second photosensitive drum and hold developer attached to a surface of the second photosensitive drum; and a second charging member configured to charge the surface of the second photosensitive drum; and a control device configured to control a transfer current flowing to the second nip, wherein the control device is configured to, when a first sheet and a second sheet are continuously conveyed in corresponding order by the conveyance belt in the monochrome mode:

supply a first transfer current for a first time period during which the first sheet or the second sheet pass through the second nip; and supply a second transfer current, which is smaller than the first transfer current, for a second time period that is a sheet interval between the first sheet and the second sheet, and wherein the control device is further configured to, when forming an image in the monochrome mode:

control the first charging member to charge the first photosensitive drum to a first charging bias; and control the second charging member to:

charge the second photosensitive drum to a second charging bias having an absolute value that is smaller than that of the first charging bias for a time period corresponding to the first time period; and charge the second photosensitive drum to a fourth charging bias that is larger than an absolute value of the second charging bias for a time period corresponding to the second time period.

10. The image forming apparatus according to claim 9, wherein the second transfer current is zero.

11. The image forming apparatus according to claim 9, wherein the control device is further configured to, when forming an image in the monochrome mode, control the absolute value of the second charging bias to be smaller than an absolute value of a third charging bias that is a charging potential of the second photosensitive drum when forming an image in the color mode.

12. The image forming apparatus according to claim 9, wherein the first charging member and the second charging member are scorotron-type chargers.

13. The image forming apparatus according to claim 9, wherein the first image forming unit is disposed more upstream than the second image forming unit in a sheet conveyance direction.

14. The image forming apparatus according to claim 9, further comprising:

a third image forming unit configured to form a color image together with the second image forming unit at the color mode and comprising:

a third photosensitive drum for a color except for black;

a third transfer unit configured to nip the conveyance belt with the third photosensitive drum so as to form a third nip; and a third charging member configured to charge a surface of the third photosensitive drum, wherein the third image forming unit is disposed at a downstream side just after the first image forming unit and more upstream than the second image forming unit in a sheet conveyance direction, and wherein the control device is configured to, when forming an image at the monochrome mode, control the third charging member to charge the third photosensitive drum to a fifth charging bias having an absolute value larger than that of the second charging bias.

15. The image forming apparatus according to claim 14, wherein the control device is configured to, when the first sheet and the second sheet are continuously conveyed in corresponding order by the conveyance belt at the monochrome mode, control a transfer current flowing to the third nip so as to supply a fifth transfer current for a third time period during which the first sheet and the second sheet pass through the third nip and for a fourth time period that is a sheet interval between the first sheet and the second sheet.

16. An image forming apparatus comprising:

a conveyance belt configured to convey a sheet;

a first image forming unit configured to form a monochrome image in a monochrome mode, and comprising:

a first photosensitive drum for black;

a first transfer unit configured to nip the conveyance belt with the first photosensitive drum so as to form a first nip; and a first charging member configured to charge a surface of the first photosensitive drum;

a second image forming unit configured to form a color image in a color mode, and comprising:

a second photosensitive drum for a color other than black;

a second transfer unit configured to nip the conveyance belt with the second photosensitive drum so as to form a second nip; and a second charging member configured to charge a surface of the second photosensitive drum;

a third image forming unit configured to form a color image together with the second image forming unit in the color mode, and comprising:

a third photosensitive drum for a color other than black;

a third transfer unit configured to nip the conveyance belt with the third photosensitive drum so as to form a third nip; and a third charging member configured to charge a surface of the third photosensitive drum, wherein the third image forming unit is disposed at a downstream side just after the first image forming unit and more upstream than the second image forming unit in a sheet conveyance direction, a control device configured to control a transfer current flowing to the second nip, wherein the control device is configured to, when a first sheet and a second sheet are continuously conveyed in corresponding order by the conveyance belt in the monochrome mode:

supply a first transfer current for a first time period during which the first sheet or the second sheet pass through the second nip; and supply a second transfer current, which is smaller than the first transfer current, for a second time period that is a sheet interval between the first sheet and the second sheet, and wherein the control device is configured to, when forming an image in the monochrome mode:

control the first charging member to charge the first photosensitive drum to a first charging bias;

control the second charging member to charge the second photosensitive drum to a second charging bias having an absolute value that is smaller than that of the first charging bias; and control the third charging member to charge the third photosensitive drum to a fifth charging bias having an absolute value larger than that of the second charging bias.

17. The image forming apparatus according to claim 16, wherein the second transfer current is zero.

18. The image forming apparatus according to claim 16, wherein the control device is further configured to, when forming an image in the monochrome mode, control the absolute value of the second charging bias to be smaller than an absolute value of a third charging bias that is a charging potential of the second photosensitive drum when forming an image in the color mode.

19. The image forming apparatus according to claim 16, wherein the first charging member and the second charging member are scorotron-type chargers.

20. The image forming apparatus according to claim 16, wherein the first image forming unit is disposed more upstream than the second image forming unit in a sheet conveyance direction.

* * * * *